US009520087B2

(12) United States Patent
Park et al.

(10) Patent No.: US 9,520,087 B2
(45) Date of Patent: Dec. 13, 2016

(54) ORGANIC LIGHT EMITTING DISPLAY

(71) Applicant: LG Display Co., Ltd., Seoul (KR)

(72) Inventors: Joonmin Park, Gyeonggi-do (KR); Jongsik Shim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/533,263

(22) Filed: Nov. 5, 2014

(65) Prior Publication Data

US 2015/0187267 A1 Jul. 2, 2015

(30) Foreign Application Priority Data

Dec. 26, 2013 (KR) ..... 10-2013-0164619

(51) Int. Cl.
*G09G 3/3233* (2016.01)
*G09G 3/32* (2016.01)

(52) U.S. Cl.
CPC .... *G09G 3/3233* (2013.01); *G09G 2300/0861* (2013.01); *G09G 2310/0251* (2013.01); *G09G 2310/061* (2013.01); *G09G 2320/0295* (2013.01)

(58) Field of Classification Search
CPC ..... G09G 2300/0861; G09G 2310/0251; G09G 2310/061; G09G 2320/0295; G09G 3/3233
USPC ..... 345/76, 211–212, 690–691
See application file for complete search history.

(56) References Cited

U.S. PATENT DOCUMENTS

2008/0036712 A1* 2/2008 Chung ..... G09G 3/3266 345/82
2009/0140959 A1* 6/2009 Nam ..... G09G 3/3233 345/76
2010/0085282 A1* 4/2010 Yu ..... G09G 3/3233 345/76
2013/0162617 A1* 6/2013 Yoon ..... G09G 3/3291 345/211
2013/0181969 A1* 7/2013 Kishi ..... G09G 3/3233 345/212
2014/0022289 A1* 1/2014 Lee ..... G09G 3/3283 345/691
2014/0176525 A1* 6/2014 Woo ..... G09G 3/3233 345/212
2015/0187259 A1* 7/2015 Jeong ..... G09G 3/3208 345/690

* cited by examiner

*Primary Examiner* — Quan-Zhen Wang
*Assistant Examiner* — Tony Davis
(74) *Attorney, Agent, or Firm* — Morgan, Lewis & Bockius LLP

(57) ABSTRACT

An organic light emitting display includes a display panel, on which a plurality of pixels each including an organic light emitting diode and a driving thin film transistor (TFT) controlling a current flowing in the organic light emitting diode are disposed, a timing controller configured to modulate input digital video data to compensate for changes in electric characteristic of the driving TFT, and a driving circuit unit configured to changes in electric characteristic of the driving TFT of each of specific pixels of the plurality of pixels in an image display period of each image frame and sequentially apply image display data to remaining pixels except the specific pixels along one direction in the image display period.

16 Claims, 10 Drawing Sheets

ORGANIC LIGHT EMITTING DISPLAY

This application claims the benefit of Korea Patent Application No. 10-2013-0164619 filed on Dec. 26, 2013, which is incorporated herein by reference for all purposes as if fully set forth herein.

BACKGROUND OF THE INVENTION

Field of the Invention

The present disclosure relates to a display device, and more particularly, to an organic light emitting display.

Discussion of the Related Art

An active matrix organic light emitting display includes organic light emitting diodes (hereinafter, abbreviated to "OLEDs") capable of emitting light by itself and has advantages of a fast response time, a high light emitting efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display arranges pixels each including the OLED in a matrix form and adjusts a luminance of the pixels depending on a gray scale of video data. Each pixel includes a driving thin film transistor (TFT) for controlling a driving current flowing in the OLED. There occurs a deviation in electrical characteristics (including a threshold voltage, a mobility, etc.) of the driving TFT of each pixel because of a process deviation, etc. of the organic light emitting display. Hence, the pixels have different currents (i.e., different emission amounts of the OLED) with respect to the same data voltage. As a result, the organic light emitting display has a luminance deviation.

To solve the luminance deviation, an external compensation method is known to sense changes in a characteristic parameter (for example, a threshold voltage and a mobility) of the driving TFT of each pixel and to properly correct input data depending on the sensing result. The external compensation method reduces the luminance non-uniformity resulting from changes in the electrical characteristic of the driving TFT.

The electrical characteristic of the driving TFT continuously deteriorates during a drive of the driving TFT. Thus, it is preferable to compensate for the changes in the electrical characteristic of the driving TFT in real time for an increase in a compensation performance. FIG. 1 shows a related art RT (real-time) compensation technology compensating for changes in the electrical characteristic of the driving TFT in real time using the external compensation method. As shown in FIG. 1, the related art RT compensation technology performs a sensing operation in a vertical blank period VB excluding an image display period DP from an image frame. Namely, the related art RT compensation technology senses only one display line in the vertical blank period VB of each image frame. First pixels of a display line, on which the RT sensing is not performed, maintain an emission state resulting from image display data during one image frame including the vertical blank period VB. However, second pixels of a display line, on which the RT sensing is performed, stop the emission resulting from the image display data in the vertical blank period VB, so as to perform the sensing operation. When the sensing operation is completed, luminance recovery data of the same voltage level as the image display data is input to the second pixels. The second pixels maintain an emission state resulting from the luminance recovery data during a remaining period after the vertical blank period VB.

In pixels of the display line, on which the RT sensing is performed, an emission duty resulting from the image display data in one image frame has a maximum value in one side (for example, an upper part of a display panel in FIG. 1) of the display panel, to which data is firstly applied, and gradually decreases as the display line goes from the one side of the display panel to the other side (for example, a lower part of the display panel in FIG. 1) of the display panel, to which the data is last applied. On the contrary, in the pixels of the display line, on which the RT sensing is performed, an emission duty resulting from the luminance recovery data in one image frame has a minimum value in one side (for example, the upper part of the display panel in FIG. 1) of the display panel and gradually increases as the display line goes from the one side of the display panel to the other side (for example, the lower part of the display panel in FIG. 1) of the display panel.

However, even when the image display data and the luminance recovery data are applied at the same voltage level, luminances of the image display data and the luminance recovery data represented for the same period of time are different from each other. A reason to generate such a luminance deviation is because gate signals for applying the image display data and the luminance recovery data to the pixel are different from each other. Further, the reason is because an initialization state of a source node of the driving TFT for programming the image display data is different from an initialization state of the source node of the driving TFT for programming the luminance recovery data.

As described above, when the luminance represented by the image display data is different from the luminance represented by the luminance recovery data, there occurs a luminance deviation between a display line, on which the RT sensing is performed, and display lines, on which the RT sensing is not performed, during the same image frame. A display luminance of the display line, on which the RT sensing is performed, may be greater or less than a display luminance of the display lines, on which the RT sensing is not performed. FIG. 2 shows that the display luminance in the RT sensing is greater than the display luminance in the non-RT sensing, as an example.

The luminance deviation varies depending on a display location of the display line, on which the RT sensing is performed. When the display line, on which the RT sensing is performed, is positioned at the upper part of the display panel, a length of an emission period of the luminance recovery data is short. Hence, the luminance deviation is relatively small. However, as the display line, on which the RT sensing is performed, approaches the lower part of the display panel, the length of the emission period of the luminance recovery data increases. Hence, the luminance deviation gradually increases.

Because the RT sensing is performed only on one display line in each image frame, a generation cycle of a luminance deviation (for example, a luminance deviation capable of being sufficiently perceived by the eyes) equal to or greater than a predetermined value may lengthen if the emission duty resulting from the luminance recovery data varies depending on the display location of the display line. Thus, the display line of a specific location (for example, the lower part of the display panel), on which the RT sensing is performed, may look like a line dim. This is because the human eye easily perceives a noise generated at a frequency less than a predetermined frequency (for example, 40 Hz).

When the emission duty resulting from the luminance recovery data is uniformized irrespective of the display location of the display line, the generation cycle of the luminance deviation equal to or greater than the predetermined value may shorten. Hence, a degree of the visual perception of the line dim may be greatly reduced. However, it is impossible to uniformize the emission duty resulting from the luminance recovery data at all of the display lines of the display panel through the related art RT compensation technology.

SUMMARY OF THE INVENTION

Accordingly, the present invention is directed to an organic light emitting display that substantially obviates one or more of the problems due to limitations and disadvantages of the related art.

An object of the present invention is to provide an organic light emitting display capable of reducing a degree of the visual perception of a display line, on which real-time sensing is performed, as a line dim by uniformizing an emission duty resulting from luminance recovery data to be applied to the display line, on which the real-time sensing is performed, irrespective of a location of the display line, on which real-time sensing is performed, when changes in electrical characteristic of a driving thin film transistor (TFT) are compensated in real time using an external compensation method.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting display comprises a display panel, on which a plurality of pixels each including an organic light emitting diode and a driving thin film transistor (TFT) controlling a current flowing in the organic light emitting diode are disposed, a timing controller configured to modulate input digital video data to compensate for changes in electric characteristic of the driving TFT, and a driving circuit unit configured to sense changes in electric characteristic of the driving TFT of each of specific pixels in an image display period of each image frame and sequentially apply image display data to remaining pixels except the specific pixels along one direction in the image display period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts.

Exemplary embodiments of the invention will be described with reference to FIGS. 3 to 11.

Figure 1:
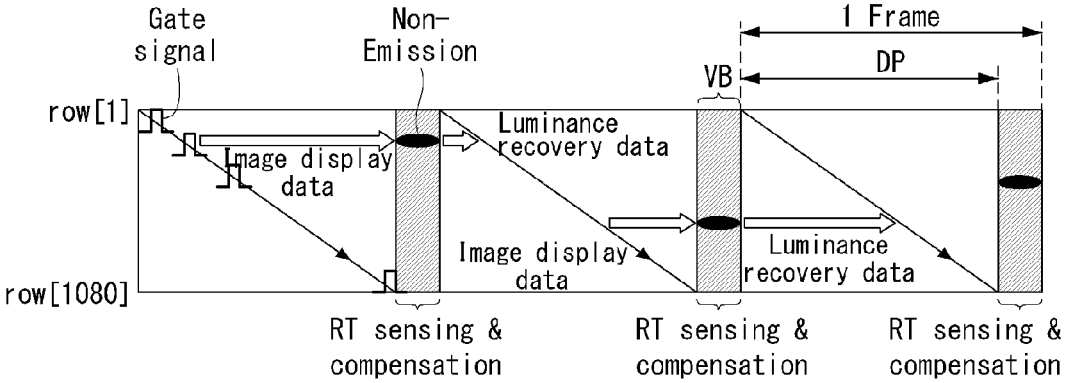
FIG. 1 (RELATED ART)
FIG. 1 illustrates a related art RT (real-time) compensation technology, in which RT sensing is performed in a vertical blank period.
Figure 2:
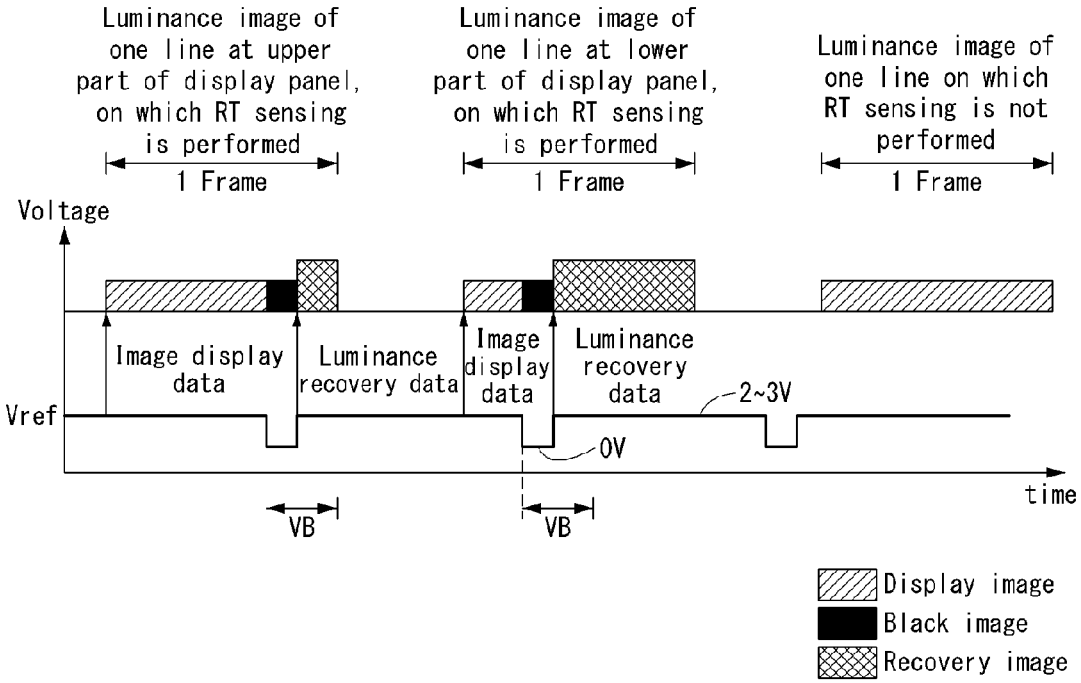
FIG. 2 (RELATED ART)
FIG. 2 illustrates a principle, in which a line dim generated by a luminance deviation is visible in a related art RT compensation technology.
Figure 3:
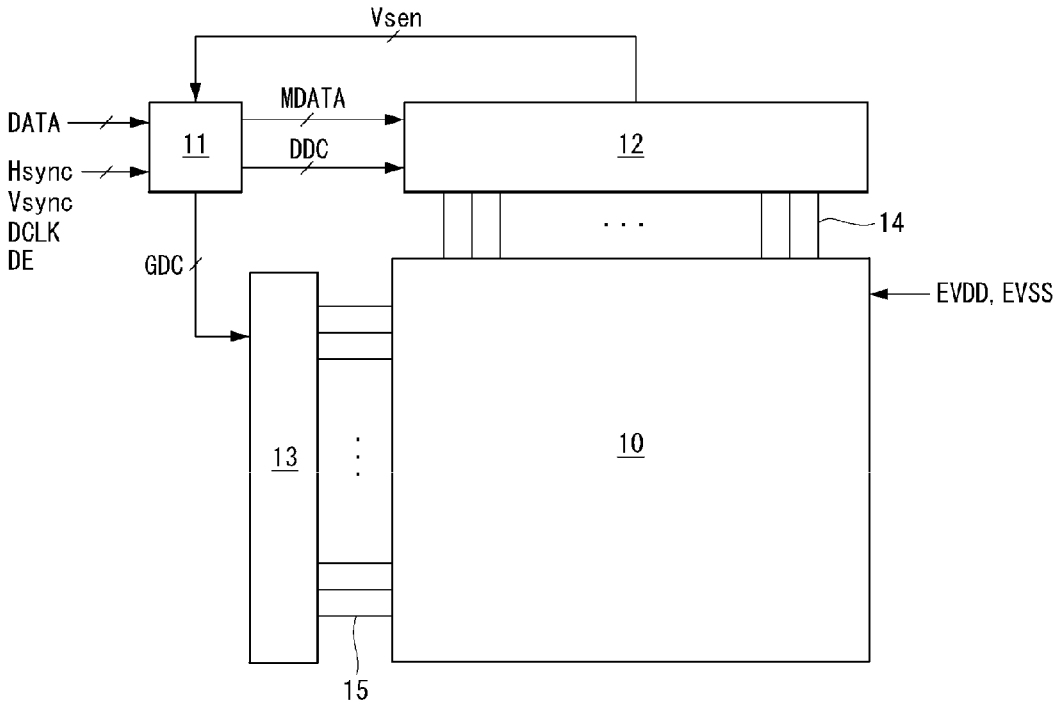
FIG. 3 is a block diagram of an organic light emitting display according to an exemplary embodiment of the invention.
Figure 4:
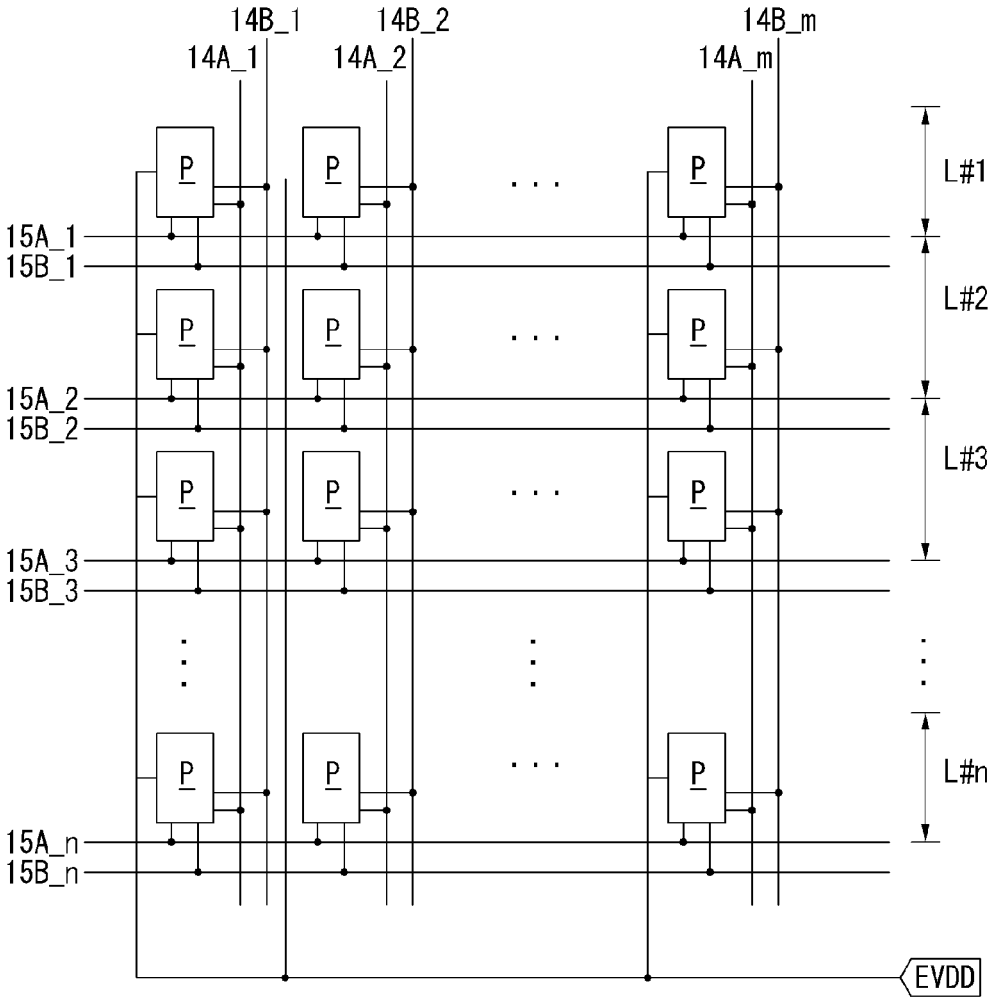
FIG. 4 shows a pixel array of a display panel shown in FIG. 3.

FIG. 3 is a block diagram of an organic light emitting display according to an exemplary embodiment of the invention, and FIG. 4 shows a pixel array of a display panel shown in FIG. 3.

As shown in FIGS. 3 and 4, the organic light emitting display according to the embodiment of the invention includes a display panel 10, a timing controller 11, and a driving circuit unit. The driving circuit unit includes a data driving circuit 12 and a gate driving circuit 13.

The display panel 10 includes a plurality of data lines 14, a plurality of gate lines 15 crossing the data lines 14, and a plurality of pixels P respectively arranged at crossings of the data lines 14 and the gate lines 15 in a matrix form. The data lines 14 include m data voltage supply lines 14A_1 to 14A_m and m reference lines 14B_1 to 14B_m, where m is a positive integer. The gate lines 15 include n first gate lines 15A_1 to 15A_n and n second gate lines 15B_1 to 15B_n, where n is a positive integer.

Each pixel P receives a high potential driving voltage EVDD and a low potential driving voltage EVSS from a power generator (not shown). Each pixel P according to the embodiment of the invention may include an organic light emitting diode (OLED), a driving thin film transistor (TFT), first and second switch TFTs, and a storage capacitor for the external compensation. The driving TFT constituting the pixel P may be implemented as a p-type transistor or an n-type transistor. Further, a semiconductor layer of the driving TFT constituting the pixel P may contain amorphous silicon, polycrystalline silicon, or oxide.

Each pixel P is connected to one of the data voltage supply lines 14A_1 to 14A_m, one of the reference lines 14B_1 to 14B_m, one of the first gate lines 15A_1 to 15A_n, and one of the second gate lines 15B_1 to 15B_n.

The driving circuit units 12 and 13 perform real-time sensing only on one display line in an image display period of each image frame under the control of the timing controller 11. Thus, the real-time sensing of n display lines L#1 to L#n is performed in n image frames, respectively. In the image display period, the driving circuit units 12 and 13 sense changes in electrical characteristics of a driving TFT of each pixel on a sensing target display line and also sequentially apply image display data to pixels on non-sensing target display lines along one direction. In the embodiment disclosed herein, the change in the electrical characteristic of the driving TFT indicates at least one of change in a threshold voltage of the driving TFT and change in a mobility of the driving TFT.

For this, the gate driving circuit 13 generates a gate pulse in response to a gate control signal GDC received from the timing controller 11. The gate pulse includes a first gate pulse SCAN (refer to FIGS. 10 and 11) sequentially supplied to the first gate lines 15A_1 to 15A_n and a second gate pulse SEN (refer to FIGS. 10 and 11) sequentially supplied to the second gate lines 15B_1 to 15B_n. The pixels positioned on one display line of the display panel 10 operate in response to the first gate pulse SCAN and the second gate pulse SEN. The one display line may be the sensing target display line or the non-sensing target display line. In one image frame, only one display line of the display panel 10 may be selected as the sensing target display line, and the remaining display lines may be the non-sensing target display lines.

The first gate pulse for driving the pixels of the sensing target display line may be different from the first gate pulse for driving the pixels of the non-sensing target display lines in a pulse shape, a pulse width, etc. Further, the second gate pulse for driving the pixels of the sensing target display line may be different from the second gate pulse for driving the pixels of the non-sensing target display lines in a pulse width, etc.

The gate driving circuit 13 may be implemented as an integrated circuit (IC) or may be directly formed on the display panel 10 through a gate driver-in panel (GIP) process.

The data driving circuit 12 supplies data voltages required in a drive to the data voltage supply lines 14A_1 to 14A_m, supplies a reference voltage to the reference lines 14B_1 to 14B_m, and performs digital processing on a sensing voltage received through the reference lines 14B_1 to 14B_m to supply the digital sensing voltage to the timing controller 11 in response to a data control signal DDC received from the timing controller 11. The data voltages required in the drive include an image display data voltage, a sensing data voltage, a black display data voltage, a luminance recovery data voltage, and the like.

The data driving circuit 12 converts digital compensation data MDATA received from the timing controller 11 into the image display data voltage and then synchronizes the image display data voltage with the first gate pulse for operating the non-sensing target display lines. The data driving circuit 12 then supplies the synchronized image display data voltage to the data voltage supply lines 14A_1 to 14A_m. The data driving circuit 12 synchronizes the sensing data voltage, the black display data voltage, and the luminance recovery data voltage with the first gate pulse for operating the sensing target display lines and sequentially supplies the synchronized voltages to the data voltage supply lines 14A_1 to 14A_m. The luminance recovery data voltage may have the same voltage level as the image display data voltage, which will be applied to another display line adjacent to a display line for the luminance recovery data voltage, so as to prevent a luminance deviation.

The timing controller 11 generates the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. Further, the timing controller 11 modulates input digital video data DATA based on the digital sensing voltage supplied from the data driving circuit 12 and generates the digital compensation data MDATA for compensating for changes in the electrical characteristics of the driving TFT. The timing controller 11 then supplies the digital compensation data MDATA to the data driving circuit 12.

Figure 5:
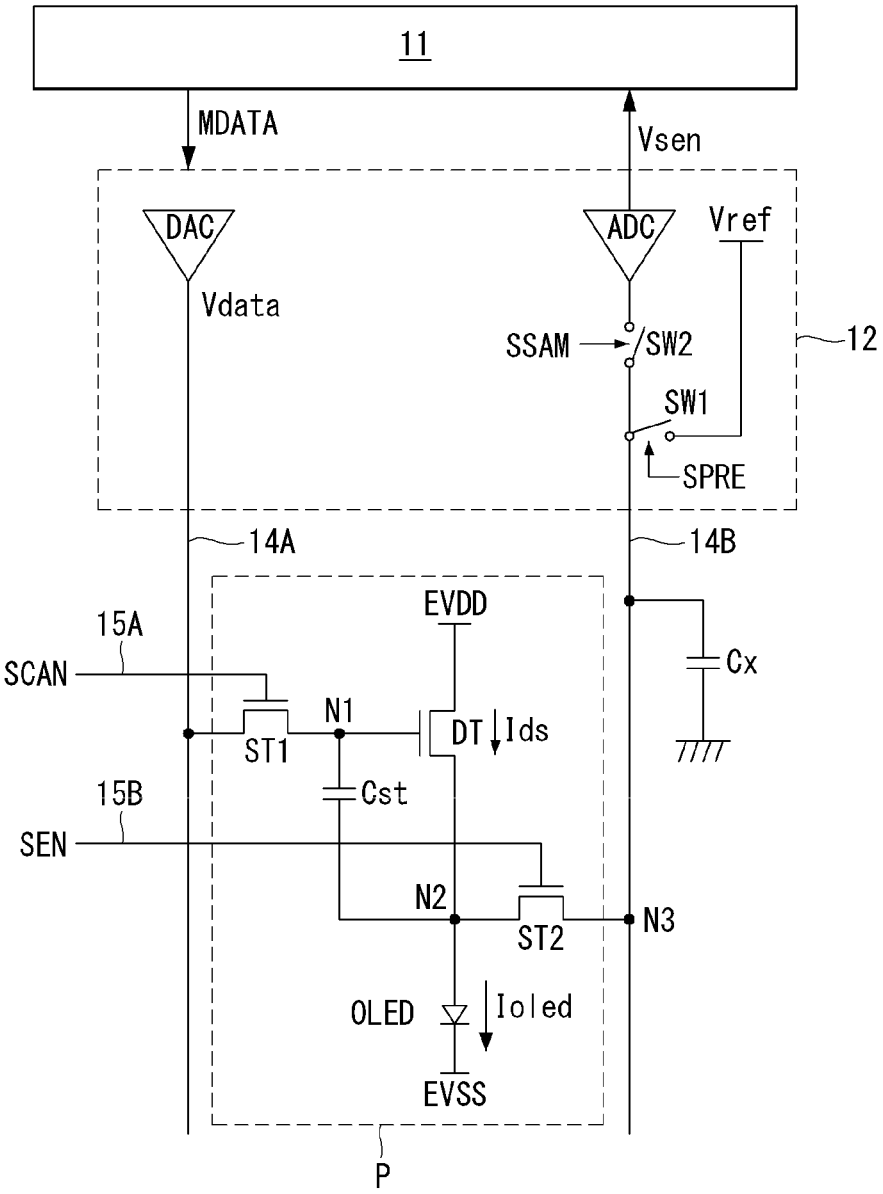
FIG. 5 illustrates a connection structure between a timing controller, a data driving circuit, and pixels along with a detailed configuration of an external compensation pixel.
Figure 6:
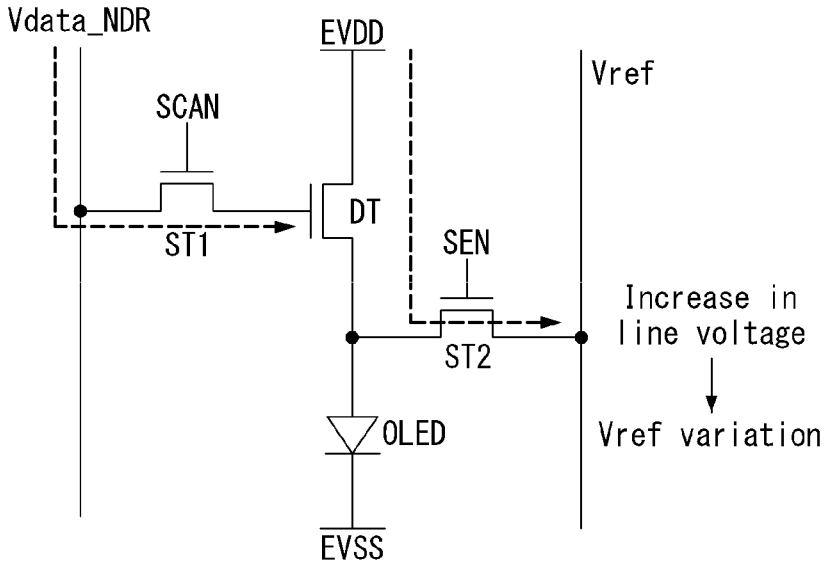
FIG. 6 illustrates a principle, in which an initialization state of a source node of a driving thin film transistor (TFT) for programming image display data is different from an initialization state of the source node of the driving TFT for programming luminance recovery data.

FIG. 5 illustrates a connection structure between the timing controller, the data driving circuit, and the pixels along with a detailed configuration of an external compensation pixel. FIG. 6 illustrates a principle, in which an initialization state of a source node of the driving TFT for programming image display data is different from an initialization state of the source node of the driving TFT for programming luminance recovery data.

As shown in FIG. 5, the pixel P capable of compensating for changes in the electrical characteristics of the driving TFT in real time using an external compensation method according to the embodiment of the invention includes an OLED, a driving TFT DT, a storage capacitor Cst, a first switch TFT ST1, and a second switch TFT ST2.

The OLED includes an anode electrode connected to a second node N2, a cathode electrode connected to an input terminal of the low potential driving voltage EVSS, and an organic compound layer positioned between the anode electrode and the cathode electrode.

The driving TFT DT includes a gate electrode connected to a first node N1, a drain electrode connected to an input terminal of the high potential driving voltage EVDD, and a source electrode connected to the second node N2. The driving TFT DT controls a driving current Ioled flowing in the OLED depending on a gate-source voltage Vgs of the driving TFT DT. The driving TFT DT is turned on when the gate-source voltage Vgs is greater than a threshold voltage Vth. As the gate-source voltage Vgs increases, a current Ids flowing between the source electrode and the drain electrode of the driving TFT DT increases. When a source voltage of the driving TFT DT is greater than a threshold voltage of the OLED, the source-drain current Ids of the driving TFT DT, as the driving current Ioled, flows through the OLED. As the driving current Ioled increases, an emission amount of the OLED increases. Hence, a descried gray scale is represented.

The storage capacitor Cst is connected between the first node N1 and the second node N2.

The first switch TFT ST1 includes a gate electrode connected to the first gate line 15A, a drain electrode connected to the data voltage supply line 14A, and a source electrode connected to the first node N1. The first switch TFT ST1 is turned on in response to the first gate pulse SCAN and applies a data voltage Vdata charged to the data voltage supply line 14A to the first node N1.

The second switch TFT ST2 includes a gate electrode connected to the second gate line 15B, a drain electrode connected to the second node N2, and a source electrode connected to the reference line 14B. The second switch TFT ST2 is turned on in response to the second gate pulse SEN and electrically connects the second node N2 to the reference line 14B.

The data driving circuit 12 is connected to the pixel P through the data voltage supply line 14A and the reference line 14B. A sensing capacitor Cx for storing a source voltage of the second node N2 as a sensing voltage Vsen may be formed on the reference line 14B. The data driving circuit 12 includes a digital-to-analog converter (DAC), an analog-to-digital converter (ADC), an initialization switch SW1, a sampling switch SW2, and the like.

The DAC generates the data voltages required in the drive, i.e., the image display data voltage, the sensing data voltage, the black display data voltage, and the luminance recovery data voltage and outputs the data voltages to the data voltage supply line 14A. The initialization switch SW1 is turned on in response to an initialization control signal SPRE and outputs a reference voltage Vref to the reference line 14B. The sampling switch SW2 is turned on in response to a sampling control signal SSAM and supplies a source voltage of the driving TFT DT, which is stored in the sensing capacitor Cx of the reference line 14B for a predetermined period of time, as the sensing voltage, to the ADC. The ADC converts an analog sensing voltage stored in the sensing capacitor Cx into the digital sensing voltage Vsen and supplies the digital sensing voltage Vsen to the timing controller 11.

In such a structure of the pixel P, pixel luminances represented by image display data and luminance recovery data of the same voltage level are different from each other. The luminance deviation is mainly generated because an initialization state of the source node of the driving TFT DT for programming the image display data is different from an initialization state of the source node of the driving TFT DT for programming the luminance recovery data.

The source node (i.e., the second node N2) of the driving TFT DT is connected to the reference line 14B and is firstly initialized before programming the gate-source voltage Vgs of the driving TFT DT according to the image display data applied to a gate node (i.e., the first node N1) of the driving TFT DT. Then, the source node N2 of the driving TFT DT is connected to the reference line 14B and is secondly initialized before programming the gate-source voltage Vgs of the driving TFT DT according to the luminance recovery data applied to the gate node N1 of the driving TFT DT.

Figure 10:
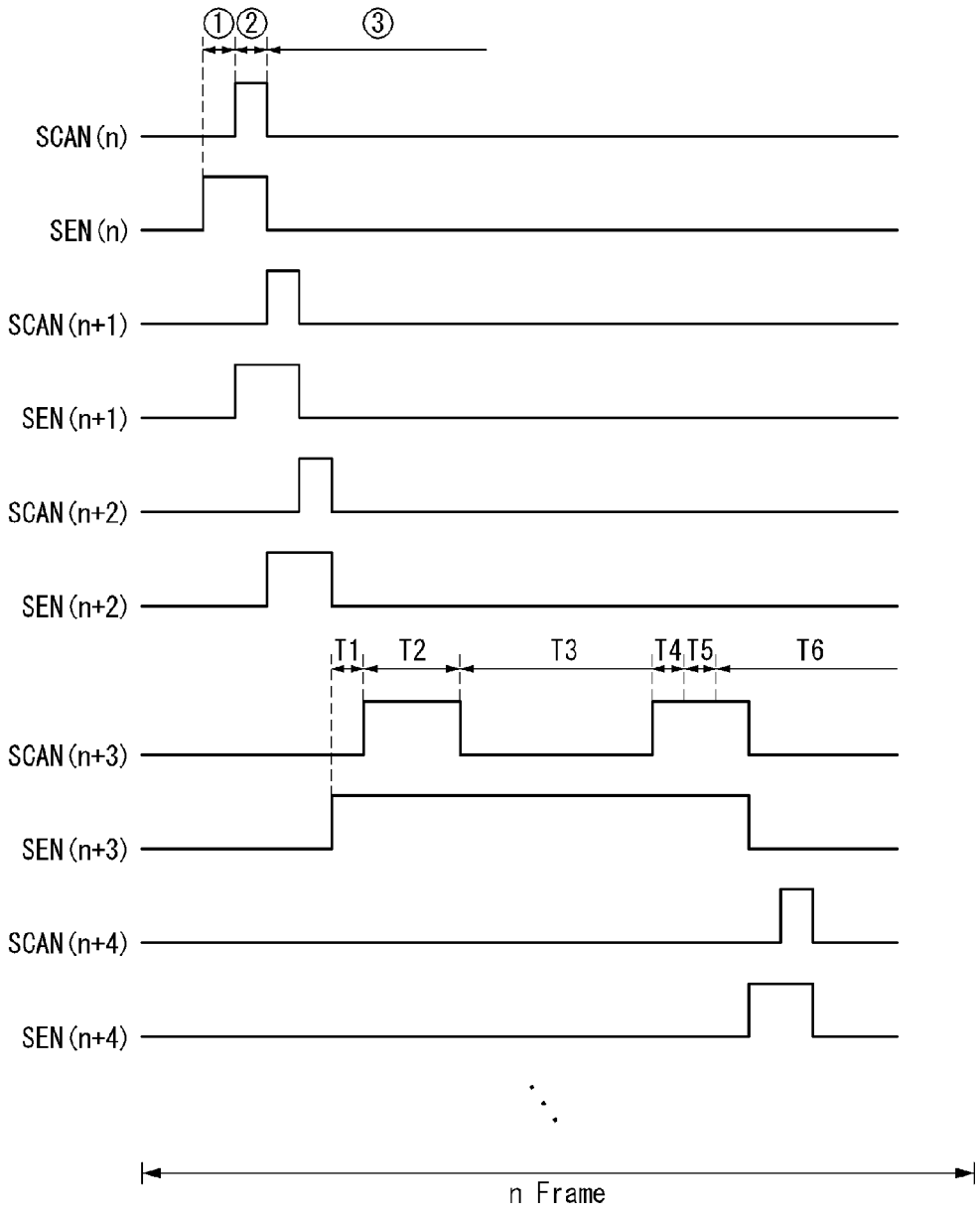
FIGS. 10 and 11 show a sensing driving signal for driving a sensing target display line during one image frame and an original image display driving signal for driving a non-sensing target display line during one image frame.

As shown in FIG. 6, the reference voltage Vref charged to the reference line 14B has to be maintained at a uniform level, but varies because of an influence of IR rising, etc. In particular, a variation of the reference voltage Vref further increases in a first initialization process for programming the image display data. In the first initialization process, as shown in FIG. 10, two adjacent display lines are simultaneously electrically connected to the reference line 14B, and the reference voltage Vref may be greater than a fixed value because of an influence of the adjacent display lines. Thus, a first initialization level of the source node N2 of the driving TFT DT becomes greater than a second initialization level of the source node N2 of the driving TFT DT. For example, when the second initialization level is zero, the first initialization level may be 2V to 3V. As described above, when the initialization state of the source node N2 of the driving TFT DT varies, emission luminances represented by the image display data and the luminance recovery data of the same voltage level are different from each other. When the emission luminances represented by the image display data and the luminance recovery data are different from each other, there occurs a luminance deviation between the display line, on which the real-time sensing is performed, and the display lines, on which the RT sensing is not performed, during the same image frame.

In a related art RT (real-time) compensation technology, when changes in electrical characteristic of a driving TFT were compensated through an external compensation method, RT sensing was performed in a vertical blank period. Therefore, an emission duty resulting from luminance recovery data varied depending on a display location of a display line, on which the RT sensing is performed. As a result, a generation cycle of the luminance deviation lengthened, and a noise of a line dim was visible.

On the other hands, the embodiment of the invention proposes a method for uniformizing an emission duty resulting from luminance recovery data to be applied to a display line, on which the RT sensing is performed, irrespective of the display location of the display line, so as to reduce a degree of the visual perception of the display line, on which the RT sensing is performed, as the noise of the line dim.

Figure 7:
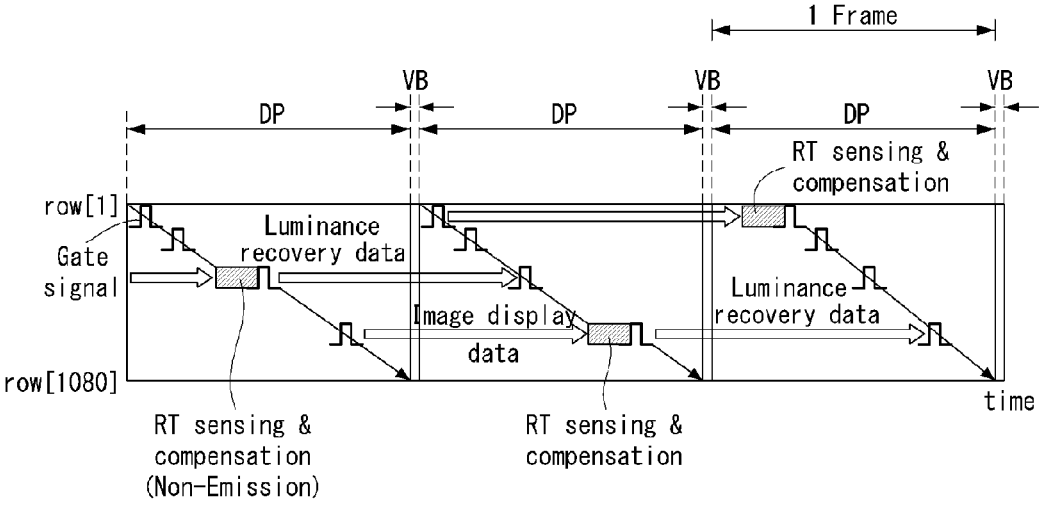
FIGS. 7 and 8 illustrate an RT compensation technology according to an exemplary embodiment of the invention, in which RT sensing is performed in an image display period of each image frame.
Figure 8:
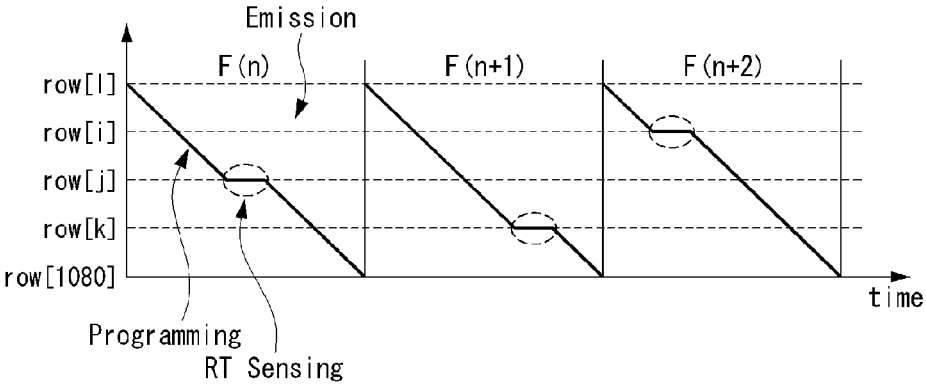
Figure 9:
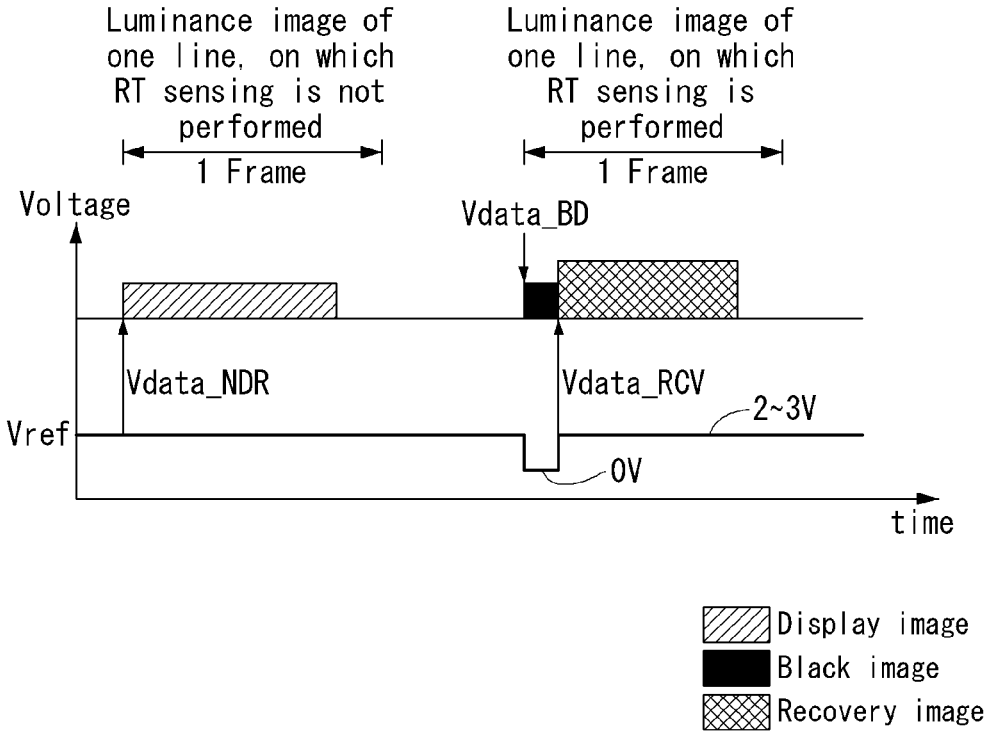
FIG. 9 shows a luminance image corresponding to one frame on a sensing target display line and a luminance image corresponding to one frame on a non-sensing target display line.

FIGS. 7 and 8 illustrate an RT compensation technology according to the embodiment of the invention, in which RT sensing is performed in an image display period of each image frame. FIG. 9 shows a luminance image corresponding to one frame on a sensing target display line and a luminance image corresponding to one frame on a non-sensing target display line.

When changes in electrical characteristic of the driving TFT are compensated through an external compensation method, the embodiment of the invention does not perform the real-time sensing in a vertical blank period VB, unlike the related art. As shown in FIG. 7, the embodiment of the invention performs the real-time sensing only on one display line in an image display period DP of each image frame. The embodiment of the invention applies the luminance recovery data to the sensing target display line, in which the real-time sensing is completed, in the image display period DP and sequentially applies the image display data to the non-sensing target display lines along one direction.

For example, as shown in FIG. 8, the embodiment of the invention performs a real-time (RT) sensing drive (including the real-time sensing and the application of the luminance recovery data) on a jth display line row[j] in an nth image frame Fn and performs a normal drive (including the application of the image display data) on remaining display lines except the jth display line row[j]. The embodiment of the invention performs the RT sensing drive on a kth display line row[k] in an (n+1)th image frame Fn+1 and performs the normal drive on remaining display lines except the kth display line row[k]. The embodiment of the invention performs the RT sensing drive on an ith display line row[i] in an (n+2)th image frame Fn+2 and performs the normal drive on remaining display lines except the ith display line row[i].

As described above, a luminance represented by the luminance recovery data is necessarily different from a luminance represented by the image display data due to the drive characteristic. Therefore, the embodiment of the invention does not focus on removing the luminance deviation and focuses on that the generated luminance deviation is not visible as the line dim. For this, as shown in FIG. 9, the embodiment of the invention uniformizes an emission duty resulting from the luminance recovery data to be applied to the display line, on which the real-time sensing is performed, irrespective of the display location.

When the emission duty resulting from the luminance recovery data is uniformized irrespective of the display location, a generation cycle of a luminance deviation (i.e., a luminance deviation between the sensing target display line and the non-sensing target display line) equal to or greater than a predetermined value may shorten. Hence, a degree of the visual perception of the line dim may be greatly reduced. Namely, because the embodiment of the invention performs the RT sensing drive only on one display line in one image frame, the generation cycle of the luminance deviation equal to or greater than the predetermined value may be reduced to about one image frame. Hence, the visual perception of the luminance deviation as the line dim is reduced. When one image frame is reduced to be equal to or less than at least 1/50 seconds, the visibility of the line dim generated by the luminance deviation is greatly reduced. Furthermore, when one image frame is 1/120 seconds, 1/240 seconds, or 1/480 seconds in accordance with a recent trend of a high-speed drive, the line dim generated by the luminance deviation is not visible.

As shown in FIG. 8, the display lines of the display panel may be non-sequentially selected as one display line, on which the RT sensing drive is performed, in each image frame. Alternatively, the display lines of the display panel may be sequentially selected. The human eye more sensitively reacts to sequential changes than non-sequential changes. Thus, in the same image frame, the non-sequential selection of the sensing target display line is more effective than the sequential selection of the sensing target display line in a reduction in the visibility of the line dim.

Figure 11:
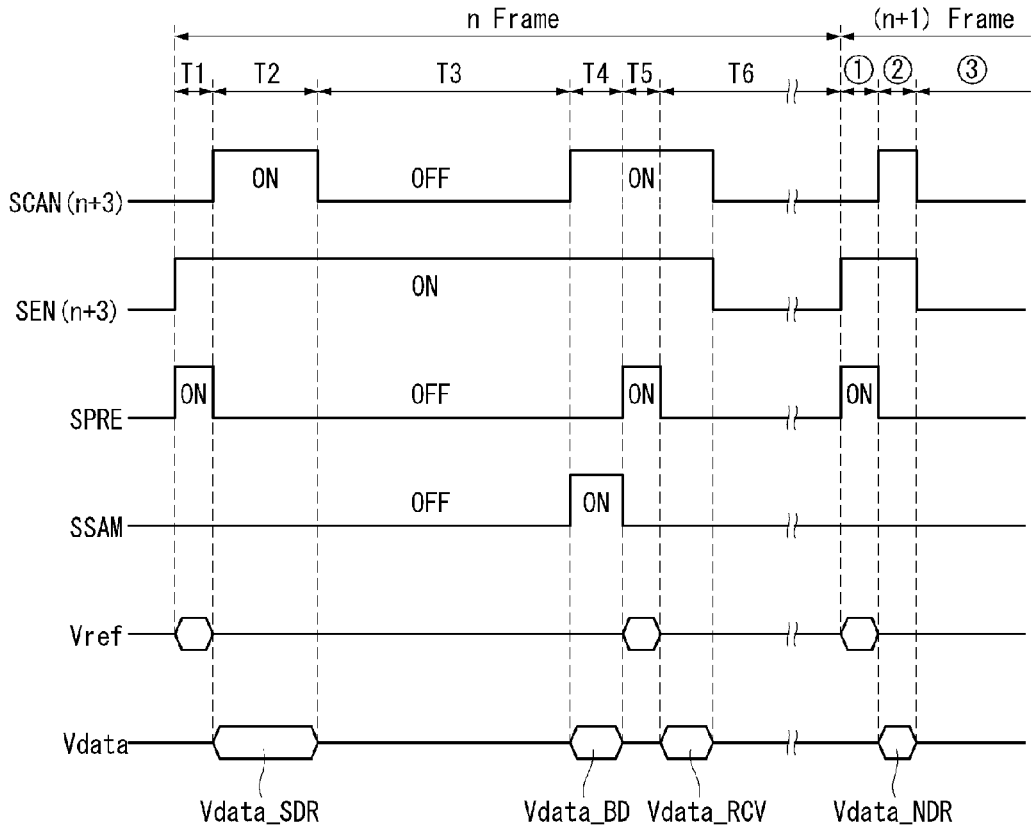

FIGS. 10 and 11 show a sensing driving signal for driving a sensing target display line during one image frame and an original image display driving signal for driving a non-sensing target display line during one image frame.

With reference to FIGS. 10 and 11 along with FIG. 5, an RT sensing driving process of a specific display line and a normal driving process of remaining display lines are schematically described below.

As shown in FIG. 10, an ath first gate pulse SCANa and an ath second gate pulse SENa drive an ath display line, where 'a' is a positive integer. For example, as shown in FIG. 10, when the normal drive is performed on nth, (n+1)th, (n+2)th, and (n+4)th display lines in an image display period, the RT sensing drive is performed on a (n+3)th display line in the image display period.

As shown in FIG. 11, one image frame (i.e., an nth frame) for performing the RT sensing drive on the (n+3)th display line includes a first initialization period T1, a programming period T2, a sensing period T3, a sampling period T4, a second initialization period T5, and an emission period T6. The (n+3)th display line is operated by a (n+3)th first gate pulse SCAN(n+3) and a (n+3)th second gate pulse SEN(n+3).

In the first initialization period T1, the first switch TFT ST1 is turned on by the first gate pulse SCAN(n+3) of an off-level, and the second switch TFT ST2 is turned on by the second gate pulse SEN(n+3) of an on-level. In this state, the data driving circuit 12 turns on the initialization switch SW1 and firstly initializes a source voltage of the driving TFT DT to the reference voltage Vref.

In the programming period T2, the first switch TFT ST1 and the second switch TFT ST2 are maintained at the on-level in response to the first gate pulse SCAN(n+3) of the on-level and the second gate pulse SEN(n+3) of the on-level, respectively. In the programming period T2, the source voltage of the driving TFT DT is maintained in the first initialization state, and a sensing data voltage Vdata_SDR is applied to the gate electrode of the driving TFT DT. As a result, the driving TFT DT is set to a turn-on state.

In the sensing period T3, the first switch TFT ST1 is turned on by the first gate pulse SCAN(n+3) of the off-level, and the second switch TFT ST2 is turned on by the second gate pulse SEN(n+3) of the on-level. In the sensing period T3, the source voltage of the driving TFT DT increases due to a current flowing between the source electrode and the drain electrode of the driving TFT DT. The source voltage of the driving TFT DT is sensed for a predetermined period of time and is stored in the sensing capacitor Cx of the reference line 14B.

In the sampling period T4, the first switch TFT ST1 and the second switch TFT ST2 are maintained at the on-level in response to the first gate pulse SCAN(n+3) of the on-level and the second gate pulse SEN(n+3) of the on-level, respectively. The data driving circuit 12 turns on the sampling switch SW2 and samples the sensed source voltage, thereby detecting changes in the electrical characteristics of the driving TFT DT. In the sampling period T4, the source voltage of the driving TFT DT is greater than a threshold voltage of the OLED, and thus the unnecessary emission may be caused. Thus, a black display data voltage Vdata_BD may be applied to the gate electrode of the driving TFT DT, so as to prevent the unnecessary emission. Hence, the gate-source voltage Vgs of the driving TFT is less than the threshold voltage Vth of the driving TFT by the black display data voltage Vdata_BD, and a current flowing between the source electrode and the drain electrode of the driving TFT is cut off.

In the second initialization period T5, the first switch TFT ST1 and the second switch TFT ST2 are maintained at the on-level in response to the first gate pulse SCAN(n+3) of the on-level and the second gate pulse SEN(n+3) of the on-level, respectively. In this state, the data driving circuit 12 turns on the initialization switch SW1 and secondly initializes the source voltage of the driving TFT DT to the reference voltage Vref.

In the emission period T6, the first and second switch TFTs ST1 and ST2 are maintained in a turn-on state for a predetermined period of time in response to the first gate pulse SCAN(n+3) of the on-level and the second gate pulse SEN(n+3) of the on-level, respectively, and then are maintained in a turn-off state in response to the first gate pulse SCAN(n+3) of the off-level and the second gate pulse SEN(n+3) of the off-level, respectively. When the first and second switch TFTs ST1 and ST2 are maintained in the turn-on state, the source voltage of the driving TFT DT is maintained in the second initialization state, and a luminance recovery data voltage Vdata_RCV is applied to the gate electrode of the driving TFT DT. As a result, the driving TFT DT is turned on, and a luminance recovery driving current is applied to the OLED. Even when the first and second switch TFTs ST1 and ST2 are turned off, the gate-source voltage of the driving TFT DT is uniformly maintained by the storage capacitor Cst. Therefore, the luminance recovery driving current is maintained to a uniform value in the emission period T6. The OLED emits light depending on the luminance recovery driving current and displays a luminance recovery image during the emission period T6.

As shown in FIG. 10, one image frame (i.e., an nth frame) for performing the normal drive on the remaining display lines except the (n+3)th display line includes an initialization period (1), a programming period (2), and an emission period (3). The nth display line operated by an nth first gate pulse SCANn and an nth second gate pulse SENn is described as an example.

In the initialization period (1), the first switch TFT ST1 is turned off by the first gate pulse SCANn of an off-level, and the second switch TFT ST2 is turned on by the second gate pulse SENn of an on-level. In this state, the data driving circuit 12 turns on the initialization switch SW1 and initializes a source voltage of the driving TFT DT to the reference voltage Vref.

In the programming period (2), the first switch TFT ST1 and the second switch TFT ST2 are turned on in response to the first gate pulse SCANn of the on-level and the second gate pulse SENn of the on-level, respectively. In this instance, the source voltage of the driving TFT DT is maintained in the initialization state, and an image display data voltage Vdata_NDR is applied to the gate electrode of the driving TFT DT. As a result, the driving TFT DT is turned on, and an image display driving current flows between the source electrode and the drain electrode of the driving TFT.

In the emission period (3), even when the first and second switch TFTs ST1 and ST2 are turned off, the gate-source voltage of the driving TFT DT is uniformly maintained by the storage capacitor Cst. Therefore, the image display driving current is maintained to a uniform value during the emission period (3). The OLED emits light depending on the image display driving current and displays an original display image during the emission period (3).

As described above, the embodiment of the invention does not perform the real-time sensing in the vertical blank period and performs the real-time sensing only on one display line in the image display period of each image frame when the changes in the electrical characteristic of the driving TFT are compensated using the external compensation method. The embodiment of the invention applies the luminance recovery data to the sensing target display line, in which the real-time sensing is completed, in the image display period and sequentially applies the image display data to the non-sensing target display lines along one direction.

Hence, the embodiment of the invention uniformizes the emission duty resulting from the luminance recovery data to be applied to the display line, on which the real-time sensing is performed, irrespective of the display location of the display line, thereby greatly reducing the degree of the visual perception of the display line, on which the real-time sensing is performed, as the line dim.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display, comprising:

a display panel, on which a plurality of pixels each including an organic light emitting diode and a driving thin film transistor (TFT), for controlling a current flowing in the organic light emitting diode, are disposed;

a timing controller configured to modulate input digital video data to compensate for changes in electric characteristic of the driving TFT; and a driving circuit unit configured, in an image display period of each image frame, to:

sense the changes in electric characteristic of the driving TFT of each of specific pixels on one display line selected among display lines of the display panel and apply luminance recovery data to the specific pixels based on the sensed changes, the image display period being a remaining period excluding a vertical blank period from each image frame; and sequentially apply image display data to pixels on remaining lines among the display lines of the display panel, except the specific pixels along one direction, while not sensing the changes in electric characteristic of the driving TFT of the pixels on the remaining lines, wherein one image frame assigned to the specific pixels includes:

a first initialization period, in which a source voltage of the driving TFT included in each of the specific pixels is firstly initialized to a reference voltage, a programming period, in which a sensing data voltage is applied to a gate electrode of the driving TFT in the first initialization state of the source voltage of the driving TFT and sets the driving TFT to a turn-on state, a sensing period, in which the source voltage of the driving TFT increased by a current flowing in the driving TFT is sensed and stored for a predetermined period of time, a sampling period, in which the sensed source voltage is sampled and detects the changes in the electric characteristic of the driving TFT, a second initialization period, in which the source voltage of the driving TFT is secondly initialized to the reference voltage, and an emission period, in which a luminance recovery data voltage is applied to the gate electrode of the driving TFT in the second initialization state of the source voltage of the driving TFT to turn on the driving TFT, and the organic light emitting diode operates using a luminance recovery driving current applied through the driving TFT to display a luminance recovery image, and wherein one image frame assigned to the pixels on the remaining lines includes:

an initialization period, in which a source voltage of the driving TFT included in each of the pixels on the remaining lines is initialized to the reference voltage, a programming period, in which an image display data voltage is applied to the gate electrode of the driving TFT in the initialization state of the source voltage of the driving TFT and turns on the driving TFT, and an emission period, in which the organic light emitting diode operates using an image display driving current applied through the driving TFT and displays an original image.

2. The organic light emitting display of claim 1, wherein the one display line is sequentially selected among the display lines of the display panel along the one direction.

3. The organic light emitting display of claim 1, wherein the one display line is non-sequentially selected among the display lines of the display panel irrespective of the one direction.

4. The organic light emitting display of claim 1, wherein an emission duty of the organic light emitting diode for displaying the luminance recovery image is the same in all of the display lines of the display panel irrespective of a location of the specific pixels on the display panel.

5. The organic light emitting display of claim 1, wherein a black display data voltage capable of turning off the driving TFT is applied to the gate electrode of the driving TFT during the sampling period.

6. The organic light emitting display of claim 1, wherein the luminance recovery data voltage has the same voltage level as the image display data voltage to be applied to a display line next to a display line, to which the luminance recovery data voltage is applied.

7. The organic light emitting display of claim 1, wherein the change in the electrical characteristic of the driving TFT indicates at least one of change in a threshold voltage of the driving TFT and change in a mobility of the driving TFT.

8. An organic light emitting display, comprising:

a display panel, on which a plurality of pixels each including an organic light emitting diode and a driving thin film transistor (TFT), for controlling a current flowing in the organic light emitting diode, are disposed;

a timing controller configured to modulate input digital video data to compensate for changes in electric characteristic of the driving TFT; and a driving circuit unit configured to:

sense the changes in electric characteristic of the driving TFT of each of specific pixels in an image display period of each image frame and sequentially apply image display data to remaining pixels except the specific pixels along one direction in the image display period, wherein one image frame assigned to the specific pixels includes:

a first initialization period, in which a source voltage of the driving TFT included in each of the specific pixels is firstly initialized to a reference voltage, a programming period, in which a sensing data voltage is applied to a gate electrode of the driving TFT in the first initialization state of the source voltage of the driving TFT and sets the driving TFT to a turn-on state, a sensing period, in which the source voltage of the driving TFT increased by a current flowing in the driving TFT is sensed and stored for a predetermined period of time, a sampling period, in which the sensed source voltage is sampled and detects the changes in the electric characteristic of the driving TFT, a second initialization period, in which the source voltage of the driving TFT is secondly initialized to the reference voltage, and an emission period, in which a luminance recovery data voltage is applied to the gate electrode of the driving TFT in the second initialization state of the source voltage of the driving TFT to turn on the driving TFT, and the organic light emitting diode operates using a luminance recovery driving current applied through the driving TFT to display a luminance recovery image, and wherein one image frame assigned to the remaining pixels includes:

an initialization period, in which a source voltage of the driving TFT included in each of the remaining pixels is initialized to the reference voltage, a programming period, in which an image display data voltage is applied to the gate electrode of the driving TFT in the initialization state of the source voltage of the driving TFT and turns on the driving TFT, and an emission period, in which the organic light emitting diode operates using an image display driving current applied through the driving TFT and displays an original image.

9. The organic light emitting display of claim 8, wherein the image display period is a remaining period excluding a vertical blank period from each image frame.

10. The organic light emitting display of claim 8, wherein the specific pixels selected in each image frame are pixels on one display line of the display panel.

11. The organic light emitting display of claim 8, wherein:

the specific pixels are selected as pixels on one display line of the display panel among the plurality of pixels of the display panel in each image frame; and the display line of the specific pixels is sequentially selected among display lines of the display panel along the one direction.

12. The organic light emitting display of claim 8, wherein:

the specific pixels are selected as pixels on one display line of the display panel among the plurality of pixels of the display panel in each image frame, and the display line of the specific pixels is non-sequentially selected among display lines of the display panel irrespective of the one direction.

13. The organic light emitting display of claim 8, wherein an emission duty of the organic light emitting diode for displaying the luminance recovery image is the same in all of display lines of the display panel irrespective of a location of the specific pixels on the display panel.

14. The organic light emitting display of claim 8, wherein a black display data voltage capable of turning off the driving TFT is applied to the gate electrode of the driving TFT during the sampling period.

15. The organic light emitting display of claim 8, wherein the luminance recovery data voltage has the same voltage level as the image display data voltage to be applied to a display line next to a display line, to which the luminance recovery data voltage is applied.

16. The organic light emitting display of claim 8, wherein the change in the electrical characteristic of the driving TFT indicates at least one of change in a threshold voltage of the driving TFT and change in a mobility of the driving TFT.

* * * * *